US005184863A

United States Patent [19]

Hurson

[11] Patent Number: 5,184,863

[45] Date of Patent: Feb. 9, 1993

[54] SKI CARRIER

[76] Inventor: James K. Hurson, R.R. #3, Shelburne, Ontario, Canada, L0N150

[21] Appl. No.: 827,278

[22] Filed: Jan. 29, 1992

Related U.S. Application Data

[63] Continuation-in-part of Ser. No. 648,488, Feb. 1, 1991, abandoned.

[51] Int. Cl.[5] ..... A63C 11/02; B65D 69/00

[52] U.S. Cl. ..... 294/147; 294/163; 294/165

[58] Field of Search ..... 294/116, 137, 146, 147, 294/159-161, 163, 165, 166; 280/814, 815; 224/917

[56] References Cited

U.S. PATENT DOCUMENTS

| | | | |
|---|---|---|---|
| 3,114,487 | 12/1963 | Miller et al. | 294/147 |
| 3,307,759 | 3/1967 | Fulton | 224/45 |
| 3,985,275 | 10/1976 | Allen | 224/45 S |
| 3,990,655 | 11/1976 | Covell | 224/45 |
| 4,020,661 | 5/1977 | Rich | 280/814 X |
| 4,043,493 | 8/1977 | Camelio | 294/147 X |
| 4,171,079 | 10/1979 | Dietlein et al. | 224/45 |
| 4,190,182 | 2/1980 | Hickey | 224/45 |
| 4,274,571 | 6/1981 | Lafreniere et al. | 294/147 |
| 4,319,686 | 3/1982 | Avocat | 280/814 X |
| 4,320,916 | 3/1982 | Crump | 294/147 |
| 4,333,677 | 6/1982 | Crump | 294/147 |
| 4,458,935 | 7/1984 | Fields, Jr. | 294/147 |
| 4,460,207 | 7/1984 | Gies | 294/147 |
| 4,491,359 | 1/1985 | Metropulos | 294/147 |
| 4,659,129 | 4/1987 | Schuetzeberg et al. | 294/147 |

FOREIGN PATENT DOCUMENTS

| | | | |
|---|---|---|---|
| 2635692 | 3/1990 | France | 294/147 |
| 8807396 | 10/1988 | World Int. Prop. O. | 280/814 |

*Primary Examiner*—Charles A. Marmor
*Assistant Examiner*—Dean J. Kramer
*Attorney, Agent, or Firm*—Foley & Lardner

[57] ABSTRACT

A hand-held ski carrier includes a rigid base member, a handle projecting from a central portion of the base member, and at least one jaw. Each jaw preferably comprises an outer side member which extends from a lateral side portion of the base member, and an inner side member which is disposed between the outer side member and the handle and which extends generally vertically from the base member in parallel with the outer side member. The handle is rotatable with respect to the base member, and a cam member is mounted on the handle and is adapted to rotate with the handle from a first, neutral position to a second position in which it drives the upper portions of at least one of the inner and outer side members towards the other member to close the jaw.

36 Claims, 7 Drawing Sheets

SKI CARRIER

CROSS REFERENCE TO RELATED APPLICATIONS

The present application shares disclosure and claims with co-pending U.S. patent application Ser. No. 07/648,488, filed in the name of James K. Hurson on Feb. 1, 1991 now abandoned. This application is therefore believed to be entitled to the filing date of the earlier application pursuant to 35 USC 120, and such benefit is hereby claimed.

BACKGROUND OF THE INVENTION

The present invention relates to a device for carrying elongated objects, and, more particularly, relates to a hand-held device for carrying skis and poles.

Skis and ski-poles are difficult to transport by hand since their length makes them somewhat cumbersome to carry. This problem is compounded by the fact that several such objects must be transported simultaneously. Various hand-held carriers have been proposed which attempt to solve or at least alleviate these problems. One such carrier is disclosed in U.S. Pat. No. 3,990,665, which issued to J. Covell on Nov. 9, 1976. This device includes a rectangular base member, a handle which is attached to a central portion of the base member via a support member, and a pair of "wings" which are hinged at their lower ends to lateral edges of the base members. When using this device, the user must position the skis between the handle and the wings and then pivot the wings from a substantially horizontal position to a substantially vertical position in which the skis and poles are held between the base member and the wing members. The user then inserts a bar laterally through the wing members and the support member to prevent removal of the skis from the carrier. Then, the user must thread a cable-lock through the bar to prevent the wings from opening and to allow carrying of the device.

While this carrier facilitates insertion and removal of skis, it suffers from several disadvantages which hinder its effectiveness. For example, the skis must be held in place while the wings are pivoted into position. Moreover, both wings must be held in place while the bar is inserted through the wings. These operations require considerable dexterity since the user must simultaneously position or hold the carrier and insert the skis within the device. Both hands are also required to close and lock the carrier. Moreover, the carrier is essentially useless without the cable lock since it cannot be carried unless the lock holds the wings in place.

SUMMARY OF THE INVENTION

It is therefore an object of the invention to provide a hand-held ski carrier which can stand on its own, which is simple in construction, and which can be quickly and easily loaded and un-loaded.

Another object of the invention is to provide a hand held ski carrier which can stand on its own and which can securely receive a pair of skis in a jaw of the ski holder.

In accordance with one aspect of the invention, the carrier comprises a rigid base member, a handle projecting from a central portion of the base member, and a pair of jaws. Each jaw preferably comprises an outer side member which extends from a lateral side portion of the base member, and an inner side member which is disposed between the outer side member and the handle and which extends from the base member in parallel with the outer side member. Actuating means are provided for selectively driving at least an upper portion of at least one of the inner and outer side members of each of the jaws laterally towards the other of the inner and outer side members.

In accordance with another aspect of the invention, the handle is rotatable with respect to the base member, and the actuating means comprises a cam member which is mounted on the handle and which is adapted to rotate with the handle from a first, neutral position to a second position in which it drives the upper portions of each of the inner side members towards the respective outer side member.

In accordance with yet another aspect of the invention, a bar is mounted on the handle and rotates with the handle from a first position in which it extends in parallel with the inner and outer side members to a second position in which it extends transversely of the inner and outer side members. In the second position, the bar extends transversely across upper edges of the inner side members and through a slot extending longitudinally through at least one of the outer side members to a position in which it engages a longitudinal end of the slot, and a latch and a cable lock cooperate with the bar to lock the carrier in its closed position.

In accordance with still another aspect of the invention, a ski carrier is provided which comprises a base member, a handle projecting from the base member, and a jaw. The jaw comprises an outer side member which extends from the base member, and an inner side member which is disposed between the outer side member and the handle and which extends from the base member in parallel with the outer side member. The device further comprises an actuating device which is responsive to movement of the handle and which selectively drives an upper portion of one of the inner and outer side members of the jaw laterally towards the other of the inner and outer side members.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

DETAILED DESCRIPTION OF THE PREFERRED EMBODIMENTS

Figure 1:
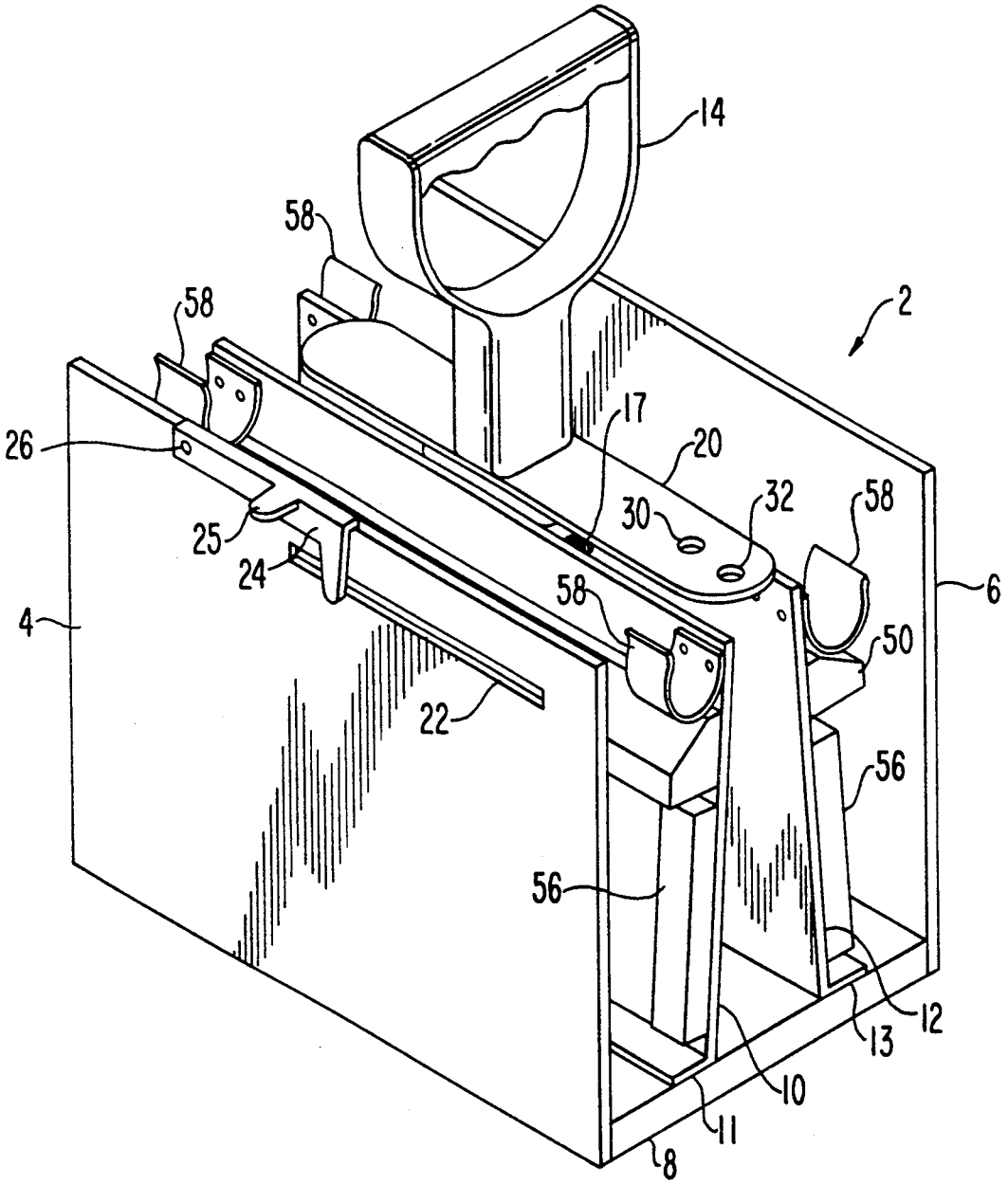
FIG. 1 is a perspective view of a ski carrier constructed in accordance with a first preferred embodiment of the invention in which the carrier is in its open position.

With reference to FIGS. 1-5, a ski carrier 2 comprises a pair of outer walls or side members 4 and 6 and a pair of inner side members 10 and 12 extending generally vertically from a generally rectangular base member 8. Each pair of inner and outer side members defines a jaw for receiving a ski and pole therein. A handle 14, an elongated cam 18, and a bar 20 are all rigidly attached to a vertically extending rod element 15 which is in turn rotatably connected to base 8 via a suitable connecting member 16. In the preferred embodiment, the handle is preferably mounted on or near the center of the base 8 and the jaws are disposed symmetrically about the handle so that the carrier can stand on its own whether it is loaded or unloaded.

Outer side members 4 and 6 are rigidly attached to the generally rectangular base member 8, and the inner side members 10 and 12 are attached to the base member via portions 11 and 13 which extend into the base member and which allow the inner side members to move or pivot laterally with respect to the base member. These lower portions 11 and 13 differ from the rigid upper portions of members 10 and 12 in that they are preferably formed of a resilient material such as stainless steel or a resilient plastic. This resilient material provides a spring-like connection between the inner side members and the base so that the inner side members pivot laterally towards the center of the carrier when the jaws are in the open position illustrated in FIG. 1. If desired, a resilient device such as a spring 17 may also be provided to help bias the upper edges of inner side members 10 and 12 towards the lateral center of the carrier. In practice, however, the resilient nature of portions 11 and 13 should provide a sufficient biasing forces. Of course, the resilient portions 11 and 13 of inner side members 10 and 12 could be replaced by hinges or by any other devices that allow lateral movement of at least the upper portions of the inner side members with respect to the base member.

The jaws defined by mating pairs of inner and outer side members are spaced far enough apart from one another to prevent interference of the skis with one another during loading. In addition, in the open position, the upper edges of the inner side members are spaced far enough apart from the outer side members to allow easy insertion of the skis into the jaws.

Elongated cam 18 rotates with handle 14 from a first, neutral position to a second position in which it forces the inner side members outwardly so that they are substantially parallel with the outer side members 4 and 6. The cam preferably is designed to cooperate with one or both of the inner side members so that it can rotate into a latched position which prevents or at least inhibits the cam member from "overshooting" its optimum orientation in which the inner side members are pushed outwardly by a maximum amount. To this end, the cam preferably is generally elliptical in shape, with one or both of the apogees 19 being flattened so that, when these portions of the cam contact the inner side members 10 and 12, further rotation of the cam is inhibited by virtue of the mating of the generally flat surfaces of the cam and the corresponding surfaces of the side members 10 and 12. Rotation of the handle beyond the optimal amount is further limited by contact between the side of a bar 20 and the longitudinal end of a slot 22. Of course, any other suitable means of latching or biasing the cam into its optimum orientation could be used in addition to or instead of the disclosed arrangements. For instance, a stop could be provided which abuts the handle and prevents further rotation of the handle when it is rotated to its optimum position.

While the generally elliptical cam 18 having flattened surfaces 19 is preferred because it provides both movement of the inner side members and at least a limited latching effect using only a single moving part, any other suitable device could be used to translate movement in the region of the handle into lateral movement of the inner side members. In addition, the disclosed combination of fixed outer side members and movable inner side members could be replaced by any combination in which one or both of the inner side members and the outer side members move towards one another, so long as the net effect of such a combination would be to press the skis between the members and to securely hold the skis in place. Moreover, the outer side members need not be attached to the outer lateral edges of the base member as illustrated in the drawings. However, it is preferable that they be spaced far enough from the handle 14 to provide sufficient spacing between the jaws to allow the user to load and unload the skis without interfering with each other.

Bar 20, which is attached to rod 15 above the top of inner side members 10 and 12, also rotates with handle 14 from a first position in which it extends in parallel with the inner side members 10 and 12 to a position in which it is substantially perpendicular to the jaws formed by the inner and outer members. During this rotation, one end of bar 20 travels through the slot 22, which is formed in outer side member 4, to a position in which the end of the bar extends a considerable distance beyond the outer surface of member 4 and contacts a longitudinal end of the slot. A latch 24, attached to outer side member 4, pivots vertically about a pin 26 into engagement with an inner hole 30 formed in bar 20 to prevent the bar and the handle from rotating. A tab 25 may be provided on the latch to facilitate its operation. In the preferred embodiment, bar 20 also has an outer hole 32 formed therein which cooperates with a cable lock 34. While this arrangement provides a convenient way of concurrently locking the carrier in its closed position and preventing its theft, the cable lock can be attached to any suitable portion of the carrier so long as it prevents un-authorized opening of the jaws and removal of the skis. In addition, the cable lock can be eliminated entirely, if desired.

Although the handle 14 is illustrated as being rigidly connected to the rod 15, the handle could be attached to the rod at a location above the bar 20 via a conventional hinge or pivot-pin arrangement which would allow the handle to "collapse" to a position in which it extends substantially in parallel with the inner and outer side walls of the carrier. Alternatively, the rigid bar 15 could be replaced with a bar which could collapse in manner similar to a telescope in order to allow the handle to be raised and lowered with respect to carrier. The provision of such a collapsible handle would provide for a carrier which is more compact when not in use, thereby facilitating storage and transportation of the carrier.

Figure 5:
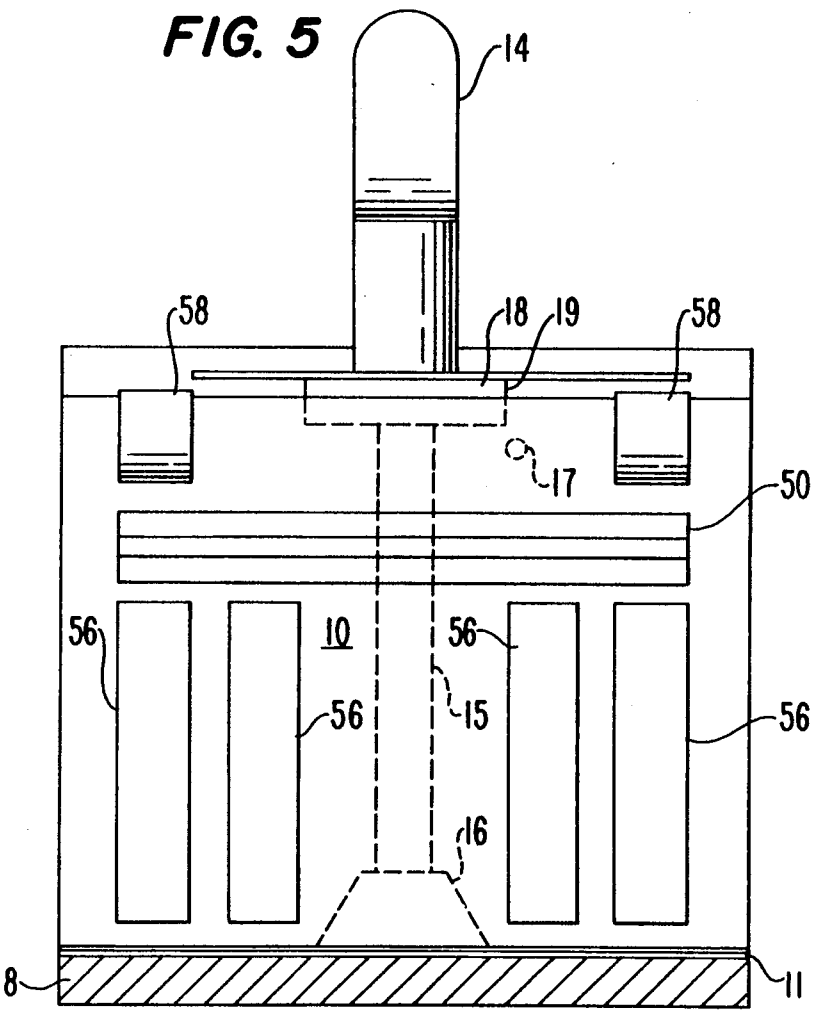
FIG. 5 is a section view taken along the line 5—5 in FIG. 4.
Figure 4:
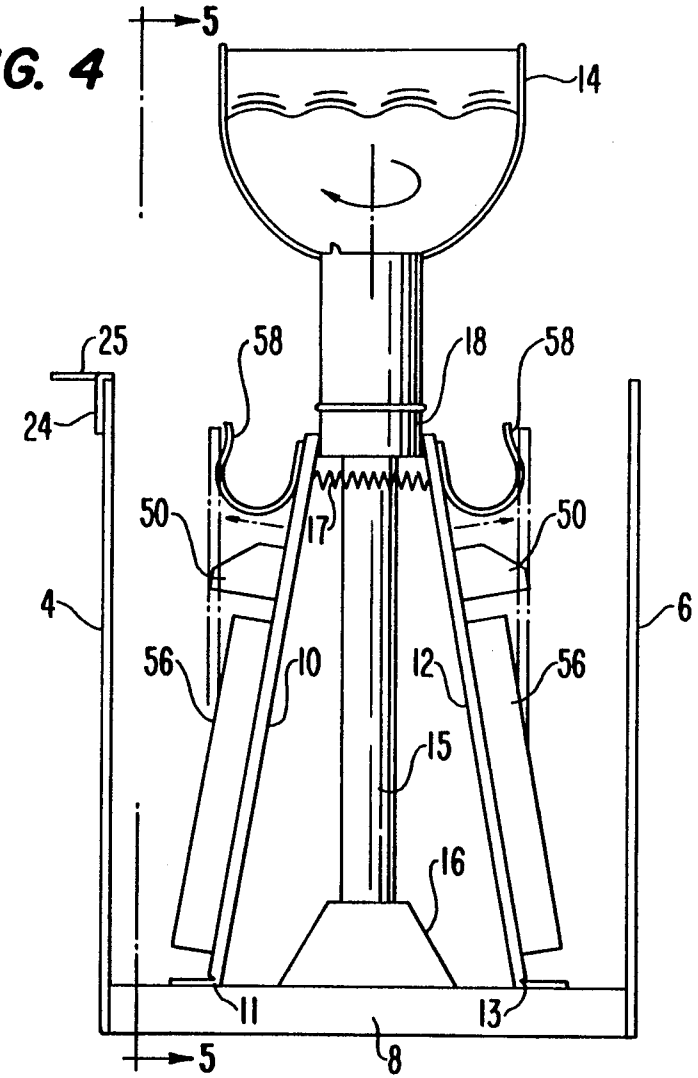
FIG. 4 is an end view of FIG. 1.

Although not essential for the operation of the device, the carrier preferably includes compressible devices which aid in securing the skis in place within the jaws. With reference to FIG. 5, these devices may include vertically-extending support members 56 which are attached to the outer surfaces of the inner side members and which project towards the outer side members. Another support member 50 extends longitudinally along the outer surface of the inner side member and projects outwardly by a sufficient amount to prevent removal of the skis when the jaws are closed.

Finally, flexible clips 58 may be attached to the upper portion of the inner side members to form holders for the poles. These clips are preferably constructed so as to allow poles of varying diameters to be securely held therein. In addition, these clips are preferably positioned below the bar 20 so that the bar extends over the poles when the carrier is closed, thereby holding the poles in place.

It should be appreciated that the placement and shape of the support members and clips can be varied as desired to provide maximum compression of skis of various widths and thicknesses. For example, the support members could be contoured to effect maximum securement of the skis. Moreover, similar support members can be attached to the inner surfaces of the outer side members to increase the cushioning and securing ability of the carrier. In addition, the clips 58 can be replaced by any suitable devices for holding the poles in the carrier, or can be eliminated altogether if the carrier is being used with skis alone.

Figure 2:
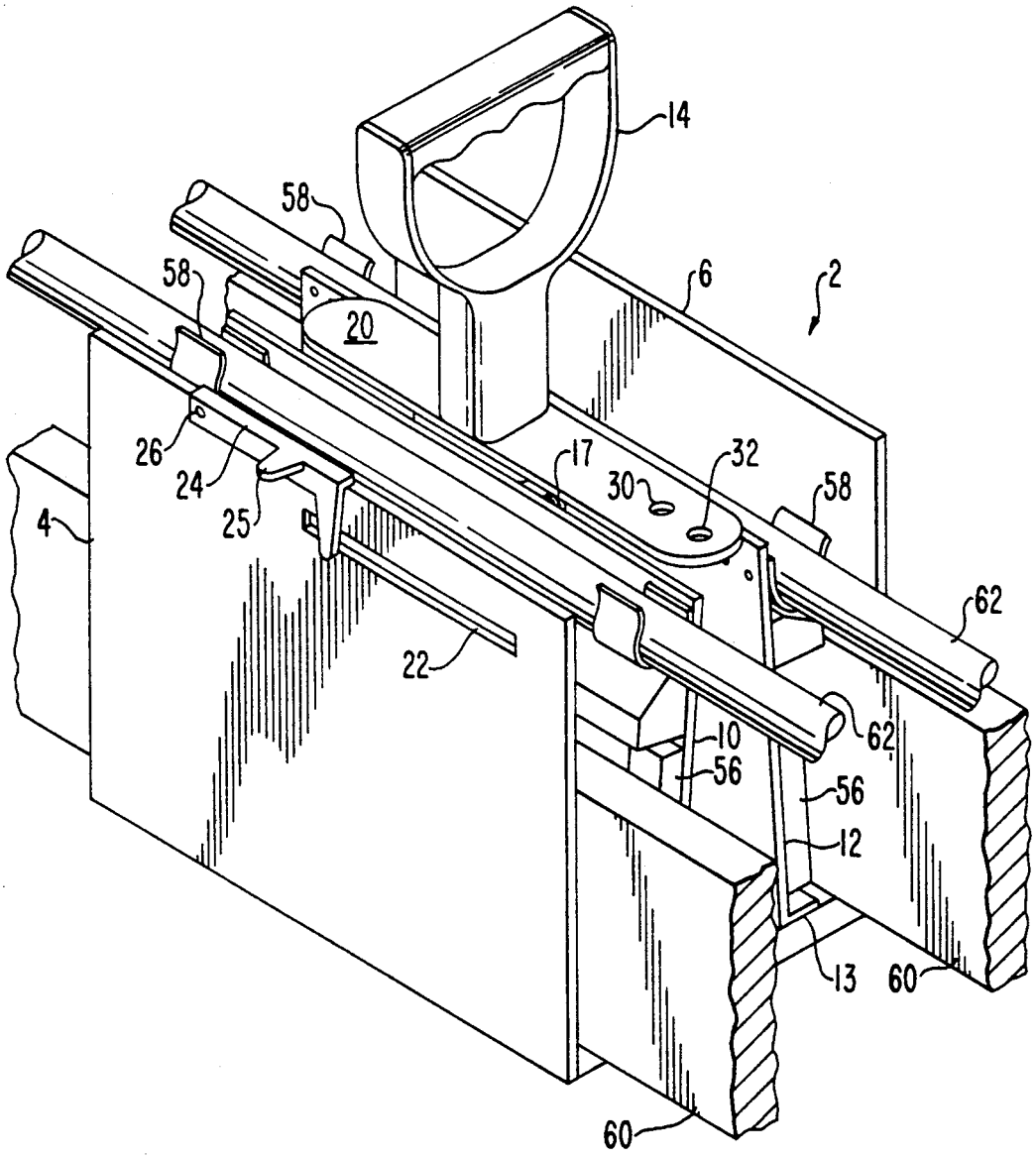
FIG. 2 illustrates the ski carrier of FIG. 1 with skis and poles inserted in the carrier.

In one convenient mode of use, the carrier is placed on the ground in the open position illustrated in FIG. 1 in which the upper edges of inner side members 10 and 12 are spaced from the outer side members 4 and 6 by a distance which is considerably wider than the skis. The user then simply drops the skis 60 into the jaws and attaches the poles 62 to the clips as illustrated in FIG. 2. Since the carrier stands on its own and does not require any alignment while the skis 60 are being loaded, the operator can use both hands to place skis 60 and poles 62 in the carrier. Moreover, the provision of the variable openings formed between the inner side members and outer side members greatly facilitates loading since the user need not worry about aligning or positioning the skis within the carrier. If the carrier is equipped with clips for poles, the user will then secure the poles to the carrier via the clips.

Next, the user rotates the handle 14 through an angle of approximately 90° so that the cam 18 forces the inner side members outwardly to press the skis within the jaws, thereby securing the skis in position. At the same time, the bar 20 rotates through the slot 22, thus forming a barrier which prevents removal of the skis 60 and poles 62 from the jaws.

When the handle is fully rotated, engagement between flattened portions 19 of the cam 18 and the inner side members inhibits further rotation of the handle and gives the user the sensation that the carrier has been latched into its fully closed position. Contact between the edge of bar 20 and the longitudinal end of slot 22 further inhibits overshoot of the handle. The operations of the cam and the bar thus provide a first level of locking which is sufficient to allow limited carrying of the device. Should the user desire a more secure connection, the latch 24 can be pivoted into engagement with the hole 30, thereby providing a second level of locking which more securely holds the bar in place. Finally, should the user desire to secure the skis in the carrier and prevent theft of the skis, a third degree of locking can be achieved by threading the cable lock 34 through the hole 32, thereby preventing unauthorized removal of the skis. If desired, the user can also ensure against theft of the carrier and skis by securing the cable lock to an object such as a tree.

Figure 3:
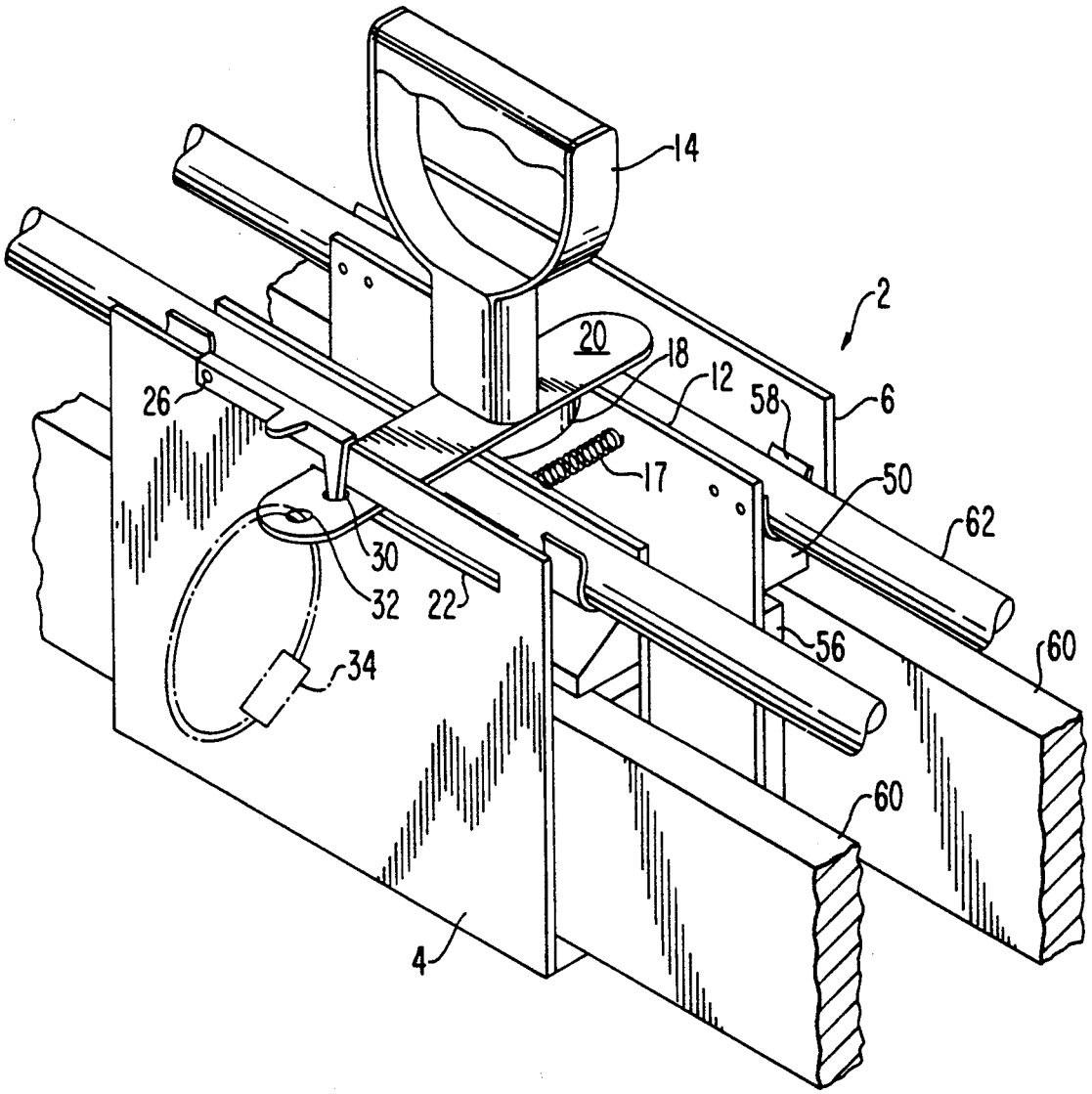
FIG. 3 illustrates the ski carrier of FIG. 1 with skis and poles in the carrier and with the carrier in its closed and latched position.

The carrier is now in the position illustrated in FIG. 3 with the skis 60 and poles 62 securely held in the carrier and with the carrier latched and locked in its closed position. The carrier is ready for transport by hand, and can be easily secured to a conventional ski-rack placed on top of a vehicle. To remove the skis and poles from the carrier, the user simply removes the cable lock 34, opens latch 24, rotates the handle 14 to its initial position, and removes the skis and poles.

Although the preferred embodiment includes a pair of jaws which are arranged on opposite sides of the handle and which are designed to accommodate a single ski in each jaw, this arrangement could be replaced by one in which a single, wider jaw is provided to accommodate two skis placed side-by-side, if desired. In this alternative embodiment, the handle could be arranged centrally over the jaw in order to enhance the stability of the carrier. Of course, if a device having a single jaw were to be used, the jaw which is eliminated should be the one which does not include the latching devices for the bar 20, thereby retaining the desired locking features of the invention.

Figure 6:
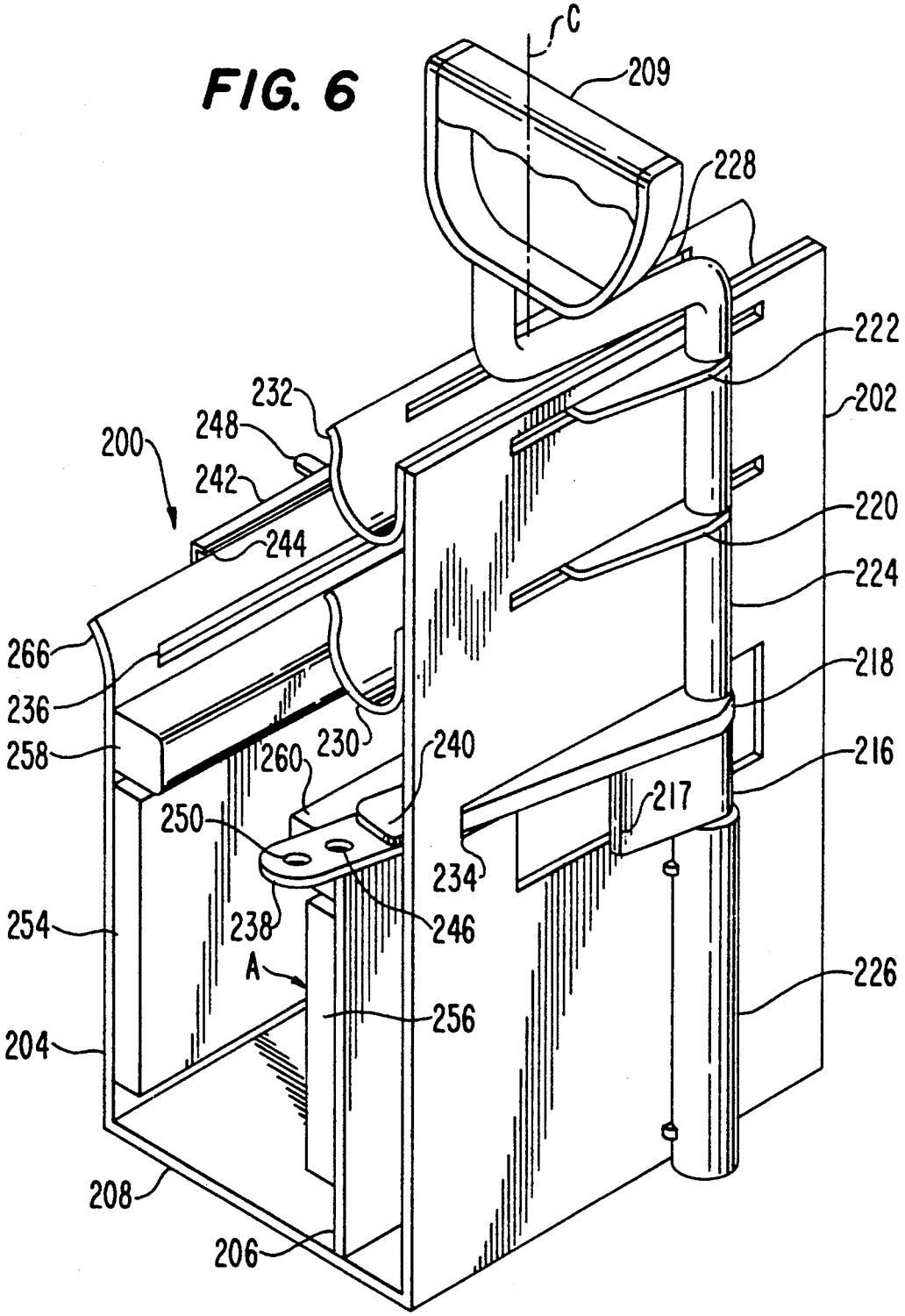
FIG. 6 is a perspective view of a ski carrier constructed in accordance with another preferred embodiment of the invention in which the carrier is in its open position.
Figure 7:
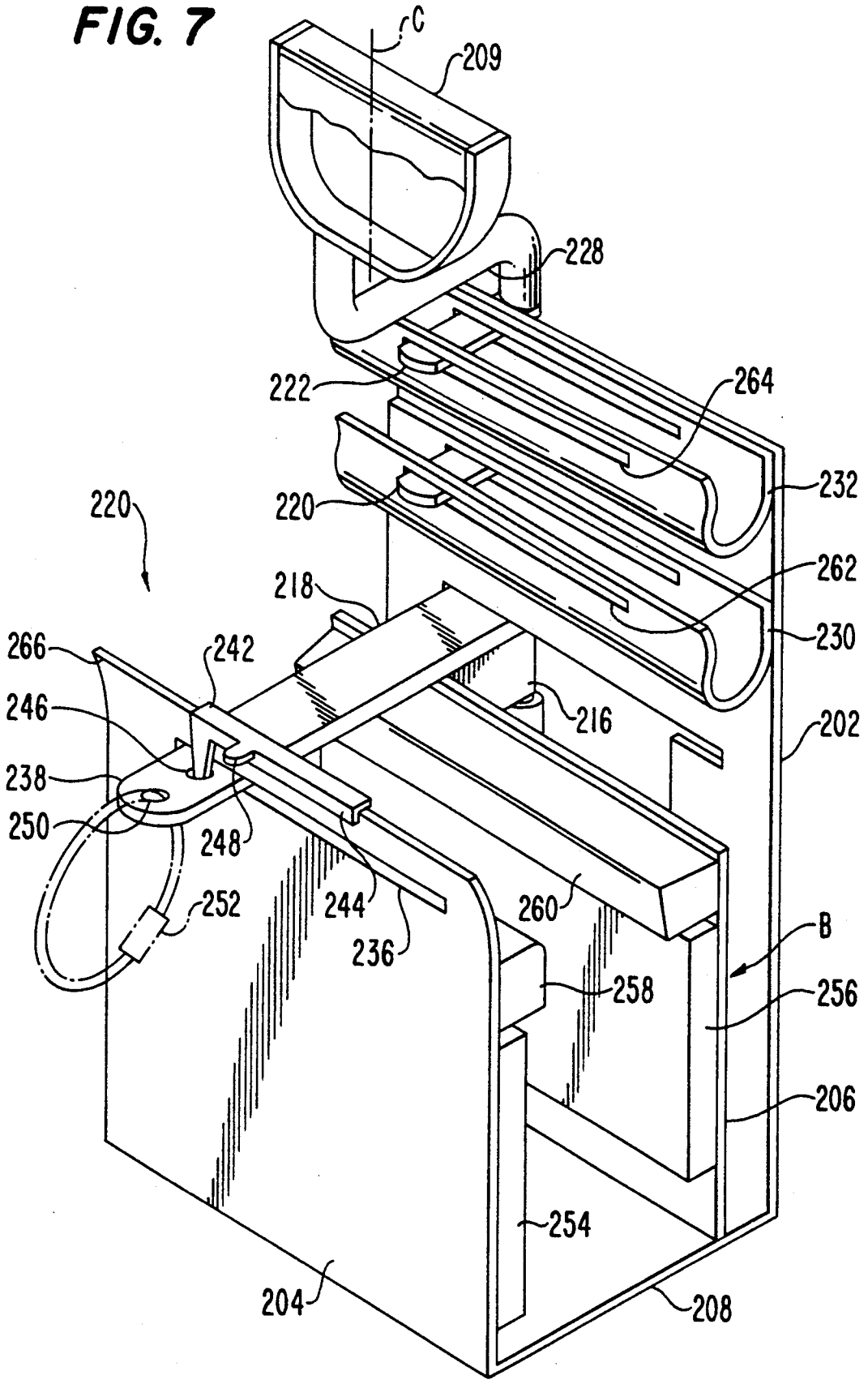
FIG. 7 illustrates the ski carrier of FIG. 6 in its closed position.

With reference to FIGS. 6 and 7, a ski carrier 200 of this type includes a vertical support member 202, and outer and inner side members 204 and 206 of a jaw which extends vertically from a generally rectangular base member 208 at positions spaced laterally outwardly from vertical support member 202. The jaw is adapted to receive a pair of skis therein in a side-by-side relationship. A handle 209, an elongated cam 216, and bars 218, 220, and 222 are all rigidly attached to a vertically extending rod element 224 which, in the illustrated embodiment, is in turn rotatably mounted on vertical support member 202 via bearing mount 226. Instead of or in addition to being mounted on support member 202, rod element 224 could be rotatably mounted on a portion of base 208 extending laterally beyond support member 202. Direct mounting of rod element 224 on base 208 would allow for the provision of a much less rigid support member since the support member 202 would then only need to be strong enough to support clips for poles. This support member could also be deleted altogether if the pole clips were to be eliminated. The resulting device would be nearly identical in construction and operation to the ski carrier of the embodiment of FIGS. 1–5 with one of the jaws removed.

In the illustrated embodiment, outer side member 204 is rigidly attached to the base member 208, and inner side member 206 is attached to the base member 208 in the same manner as the inner side members of the embodiment of FIGS. 1–5 so that this side member can pivot laterally with respect to the base member.

Elongated cam 216 rotates with the handle 209 from a first, neutral position to a second position in which it pivots the upper portion of inner side member 206 outwardly so that it is substantially parallel with the outer side member 204. As in the first embodiment, the cam preferably is designed to cooperate with the inner side member so that it can rotate into a latched position which prevents, or at least inhibits, the cam member from "overshooting" its optimum orientation in which the upper surface of inner side member 206 is pushed outwardly by a maximum amount. Also as in the first embodiment, the elliptical cam member 216 could be replaced by any other suitable device which can be used to translate movement in the region of the handle into lateral movement of the inner side member. In addition, the disclosed combination of a fixed outer side member and a movable inner side member could be replaced by any combination in which one or both of the inner and outer side members move towards one another, so long as the result of such a combination would be to press the skis between the member and to securely hold the skis in place in the jaw formed by the members.

Rod element 224 is bent at its upper portion to provide a horizontally extending portion 228 connecting the handle 209 to the remainder of the rod element 224. This horizontally extending portion enables the handle to be laterally spaced from the outer side member 202 when the carrier is in its closed position. This enhances the stability of the device by allowing the positioning of the handle at or near the center of gravity of the ski carrier.

Referring to FIG. 7, the base of the handle 209 is preferably connected to the rod 224 at a location which is longitudinally offset from the vertical center line C of the handle 209 so that when the handle is rotated from the closed position illustrated in FIG. 7 to the open position illustrated in FIG. 6, the greater portion of the longitudinal length of the handle 209 is positioned outwardly of the vertical support member 202 so as to allow easy insertion of the skis in the jaw formed by members 204 and 206 and of the poles into clips 230 and 232.

Bar 218, which is attached to rod 224 above the top of inner side member 206, also rotates with the handle 209 from a first position in which it extends substantially in parallel with the side members 204 and 206 to a position in which it is substantially perpendicular to the jaw formed by these members. In the former position, a substantial portion of the bar 218 extends laterally outwardly of a slot 234 formed in the supporting member 202. Upon rotation of the handle, the bar 218 rotates into and through a slot 236 formed in outer side member 204 and comes to rest in a position in which it is substantially perpendicular to the jaw. During this rotation, one end of bar 218 travels through the slot 236 to a position in which the end 238 of the bar extends a considerable distance beyond the outer surface of member 204 and contacts a longitudinal end of slot 236. This contact helps prevent overshooting of the handle beyond its optimum angle of rotation. Advantageously, precise positioning of the handle and bar can also be facilitated by providing a tab 240 on the bar 218 which abuts the inner lateral surface of the member 204 when the bar 218 is rotated to the fully closed position illustrated in FIG. 7.

A latch 242, attached to the outer side member 204, pivots vertically about a pin 244 into engagement with an inner hole 246 formed in bar 218 to prevent the bar and the handle from rotating. A tab 248 may be provided on the latch to facilitate this operation.

In the preferred embodiment, bar 218 also has an outer hole 250 formed therein which cooperates with a cable lock 252. Any suitable combination or key-operated lock could be used for this purpose. In addition, the lock could be provided in the form of a combination lock and cable chain. Of course, the lock need not be provided in only the illustrated position, but could also engage the bars 220 and/or 222 instead of or in addition to engaging the bar 218.

Figure 8:
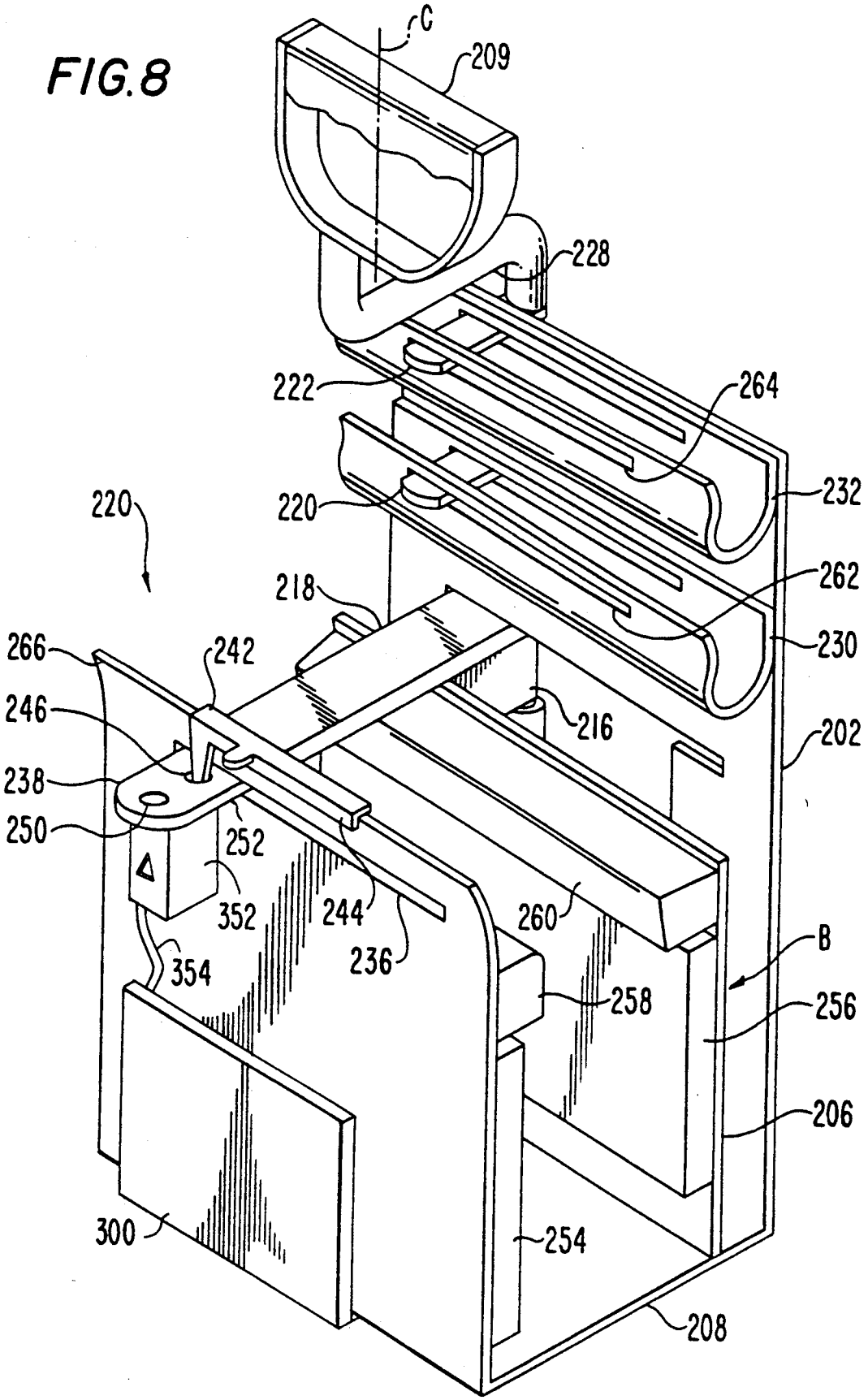
FIG. 8 is a perspective view of a modified version of the ski carrier of FIG. 6.

If desired, the lock could, as illustrated in FIG. 8, take the form of a built-in lock 352 which is permanently affixed to the outer member 204 to prevent loss or theft of the lock when the carrier is in its open position and the lock is not in use, and to facilitate latching of the lock. To this end, the latch portion of the lock 352 could be affixed to the outer surface of outer member 204 directly below the position occupied by hole 250 of bar 218 when the carrier is in the closed position illustrated in FIG. 7. The lock could then be secured simply by dropping the free end of the chain or cable 354 through the hole 250 and into the latch.

Preferably, provision is made for the storage of the lock when the lock is not in use to prevent the lock from getting in the way during transport of the carrier. This storage could be realized by placing a magnet on the outer member 204 for receiving the chain or cable of the lock, or by affixing a small pocket 300 to the outer lateral surface of outer member 204. More secure retention could be achieved by providing a lid on the pocket or by positioning a magnet in the pocket for receiving the steel cable or chain.

In the preferred embodiment, referring again to FIGS. 6 and 7, the carrier 200 includes compressible devices which aid in securing the skis in place within the jaw. In this embodiment, the compressible devices include first and second substantially rectangular lower members 254 and 256 attached to the outer and inner walls 204 and 206 defining the jaw of the carrier. Other support members 258 and 260 extend longitudinally along the outer surface of each of the inner and outer side members. Since the members 258 and 260 are thicker than members 254 and 256, these members aid in holding the skis in place by protruding above the tops of the skis after the skis have been inserted into the holder and the holder has been closed. Although the illustrated embodiment has compressible devices on the inner surfaces of each of the inner and outer members 206, and 204, these compressible devices may be provided on only a single member or may be deleted altogether, depending on the requirements of a particular application and the construction of the jaw.

Finally, as discussed above, flexible clips 230 and 232 may be provided on the vertical support member 202 to receive ski poles. Though these clips are each illustrated in the form of a unitary member, they each may be provided in the form of two or more longitudinally spaced clips of equal height as in the previous embodiment, or may be provided in the form of a web-like or mesh member. In the illustrated embodiment in which the clips each comprise a unitary member, slots 262 and 264 are formed in the clips for receiving bars 220 and 222. These bars abut longitudinal ends of the slots when the bar 218 is in contact with the longitudinal end of slot 236 and serve to inhibit removal of the poles from the carrier when it is in its closed and locked position by prohibiting the poles from being lifted vertically out of the slots.

In one convenient mode of use, the carrier 200 is placed on the ground in the open position illustrated in FIG. 6 in which the upper edge of the inner side member 206 is spaced from the upper edge of the outer side member 204 by a distance which is considerably wider than twice the thickness of the skis. Although the member 206 is illustrated in a substantially vertical position, the spring-like connection of the member 206 to base member 208 actually biases the member 206 in the direction of the arrow A in FIG. 6 so that the top of the member 206 pivots towards vertical support member 202. The user then simply places the skis together and drops them into the jaw so that their edges rest on the base 208 and so that their faces contact each other and their backs contact members 204 and 206. Then the user places the poles in the clips 230 and 232. The insertion of the skis, as well as the subsequent removal of the skis, may be facilitated by flaring the upper edge 266 of the outer side member 204 laterally away from the interior of the jaw, thereby to widen the "wedge" into which the skis are inserted. Since the carrier stands on its own and does not require any alignment while the skis are being loaded, the operator can use both hands to place the skis and poles in the carrier.

Next, the user rotates the handle 209 through an angle of approximately 90° so that the cam 216 forces the upper edge of inner side member 206 laterally inwardly in the direction of arrow B in FIG. 7 to press the skis within the jaws, thereby securing the skis in position. At the same time, the bars 218, 220, and 222 rotate through the slots 236, 262, and 264 of members 204, 230, and 232.

When the handle 209 is fully rotated, engagement between the flattened end 217 of cam 216 and the inner wall member 206 and between the flattened portion 240 of bar 218 and outer wall member 204 inhibits further rotation of the handle and gives the user the sensation that the carrier has been latched into its fully closed position. Contact between the edges of the bar members 218, 220, and 222 and the longitudinal ends of the slots with which these bars engage further inhibits "overshoot" of the handle. Thus, as in the first embodiment, the operations of the cam and the bars provide a first level of locking which is sufficient to allow limited carrying of the device. Should the user desire a more secure connection, the latch 242 can be pivoted into engagement with the hole 246 of the bar 218, thereby providing a second level of locking which more securely holds the bar in place. Finally, should the user desire to further secure the skis in the carrier, a third degree of locking can be achieved by threading the cable lock 252 through the outer hole 250 of the bar 218, thereby preventing unauthorized removal of the skis from the carrier. It can thus be seen that this embodiment of the invention provides the same three levels of locking achieved through the use of the first embodiment.

The carrier 200 is now in the position illustrated in FIG. 7 and has skis and poles securely held in the carrier with the carrier being latched and locked in its closed position. The carrier is ready for transport by hand, and can be easily secured to a conventional ski rack placed on top of a vehicle. To remove the skis and poles from the carrier, the user simply reverses the process and removes the cable lock 34, opens the latch 242, rotates the handle 209, and removes the skis.

I claim:

1. A carrier for skis comprising:

(A) a rigid base member;

(B) a handle projecting upwardly from a central portion of said base member;

(C) a pair of jaws, each jaw comprising an outer side member which extends from a lateral side portion of said base member, and an inner side member which is disposed between said outer side member and said handle and which extends from said base member in parallel with said outer side member; and (D) actuating means for selectively driving at least an upper portion of at least one of said inner and outer side members of each of said jaws laterally with respect to said base member towards the other of said inner and outer side members.

2. The carrier of claim 1, wherein each of said inner side members is pivotable with respect to said base member, and wherein said actuating means drives the upper portion of each of said inner side members towards the respective outer side member.

3. The carrier of claim 2, wherein said handle is rotatable with respect to said base member, and wherein said actuating means comprises a cam member which is mounted on said handle and which is adapted to rotate with said handle from a first, neutral position to a second position in which it drives the upper portion of each of said inner side members towards the respective outer side member.

4. The carrier of claim 3, wherein a fattened portion of said cam member engages one of said inner side members when said cam member is in said second position.

5. The carrier of claim 3, further comprising means for biasing the upper portions of said inner side members towards one another.

6. The carrier of claim 1, wherein said handle is moveable with respect to said base member, and wherein said actuating means drives said at least one of said inner and outer side members towards the other of said inner and outer side members in response to movement of said handle.

7. The carrier of claim 6, wherein said handle is rotatable with respect to said base member, and wherein said actuating means rotates with said handle.

8. The carrier of claim 7, further comprising a bar which is mounted on said handle and which rotates with said handle from a first position in which it extends in parallel with said inner and outer side members to a second position in which it extends transversely of said inner and outer side members.

9. The carrier of claim 8, wherein, in said second position, said bar extends transversely across upper edges of said inner side members and through a slot extending longitudinally through at least one of said outer side members.

10. The carrier of claim 9, further comprising a latch which is mounted on at least one of said outer side members and which is selectively engageable with said bar when said bar is in said second position.

11. The carrier of claim 10, further comprising a cable lock which cooperates with a hole formed in said bar.

12. The carrier of claim 1, further comprising compressible devices which are mounted on at least one of an inner surface of said outer side member and outer surface of said inner side member of each of said jaws.

13. The carrier of claim 1, further comprising means for holding ski poles in said jaws, said means for holding being mounted on said inner side members and extending towards said outer side members.

14. A carrier for skis and ski poles, said carrier comprising:

(A) a rigid base member;

(B) a handle projecting upwardly from a central portion of said base member;

(C) a pair of jaws for receiving respective skis and poles, each of said jaws comprising an outer side member extending from a lateral side portion of said base member, and an inner side member which is disposed between said outer side member and said handle and which extends from said base member in parallel with said outer side member; and (D) an actuating device which selectively engages at least one of said inner and outer side members of each of said jaws and which forces at least an upper portion of said at least one member laterally with respect to said base member towards the other of said inner and outer side members to force each of said jaws into a closed position in which a ski can be pressed and held between the inner and outer side members of each of said jaws.

15. The carrier of claim 14, wherein said handle is moveable with respect to said base member, and wherein said actuating device closes said jaws in response to movement of said handle.

16. The carrier of claim 15, wherein said handle is rotatable with respect to said base member, and wherein said actuating device comprises a cam which rotates with said handle.

17. The carrier of claim 14, further comprising first, second, and third means for providing progressively greater degrees of latching capability for said jaws.

18. The carrier of claim 17, wherein said handle is rotatable with respect to said base member, and wherein said first latching means comprises a cam member which rotates with said handle and which includes a flattened portion which engages one of said inner side members.

19. The carrier of claim 18, wherein said first latching means further comprises a member which is mounted on said handle and which rotates with said handle from a first position allowing insertion and removal of said skis and poles into and from said carrier to a second position preventing removal of said skis and poles from said carrier, said member engaging an element which prevents further rotation of said member when said member is in said second position.

20. The carrier of claim 19, wherein said second latching means comprises a latch which selectively engages said member when said member is in said second position.

21. The carrier of claim 17, wherein said third latching means comprises a cable lock which locks said jaws in said closed position.

22. The carrier of claim 14, further comprising fastening means, located in each of said jaws, for holding said poles.

23. A carrier for skis comprising:

(A) a base member;

(B) a handle projecting upwardly from said base member;

(C) a jaw comprising an outer side member which extends upwardly from said base member, and an inner side member which is disposed between said outer, side member and said handle and which extends upwardly from base member in parallel with said outer side member; and (D) an actuating device which is responsive to movement of said handle and which selectively drives at least an upper portion of at least one of said inner and outer side members of said jaw laterally towards the other of said inner and outer side members.

24. The carrier of claim 23, wherein said handle is mounted on a central portion of said base member, and further comprising another jaw located on an opposite lateral side of said handle from said jaw, said another jaw comprising an outer side member which extends from said base member, and an inner side member which is disposed between said outer side member and said handle and which extends from said base member in parallel with said outer side member, wherein said actuating device selectively drives at least an upper portion of at least one of said inner and outer side members of said another jaw laterally towards the other of said inner and outer side members.

25. The carrier of claim 23, wherein said inner side member is pivotable with respect to said base member, said actuating device driving the upper portion of said inner side member towards said outer side member.

26. The carrier of claim 23, wherein said handle is rotatable with respect to said base member, and wherein said actuating device comprises a cam member which is mounted on said handle and which is adapted to rotate with said handle from a first, neutral position to a second position in which it drives the upper portion of said inner side member towards the outer side member.

27. The carrier of claim 26, further comprising a vertical support member located laterally inwardly of said inner side member, and a rod which is rotatably mounted on said carrier and onto which said handle is mounted.

28. The carrier of claim 27, wherein said rod includes a horizontal portion which extends laterally outwardly toward said jaw when said handle is rotated to a position in which said carrier is closed, and wherein said handle is connected to said rod at a location which is longitudinally spaced from a vertical center line of said handle.

29. The carrier of claim 27, further comprising first and second clips connected to said vertical support member at a location above said jaw, and first, second and third bars which are connected to said rod.

30. The carrier of claim 29, wherein said cam, said first bar, said second bar, and said third bar are rotatable with said rod from positions in which they extend transversely of said jaw member to positions in which they extend generally in parallel to said jaw member.

31. The carrier of claim 29, wherein each of said clips comprises a unitary member which extends longitudinally of said vertical support member and which has a slot formed therein for receiving one of said second and third bars.

32. A carrier for skis comprising:

(A) a base member;

(B) a handle, projecting upwardly from said base member, for carrying said carrier;

(C) a jaw including an outer side member which extends upwardly from said base member and which extends longitudinally of said base member, and an inner side member which is disposed between said outer side member and said handle and which extends upwardly from said base member and longitudinally of said base member generally in parallel with said outer side member; and (D) an actuating device which selectively drives at least an upper portion of at least one of said inner and outer side members laterally of said base member towards the other of said inner and outer side members.

33. The carrier of claim 32, wherein said handle is movable with respect to said base member, and wherein said actuating device comprises a member which moves with said handle from a first, neutral position to a second position in which it drives at least said portion of said one of said inner and outer side members laterally towards the other of said inner and outer side members.

34. The carrier of claim 32, further comprising a cable lock which locks said jaw in a closed position.

35. The carrier of claim 34, wherein said cable lock is affixed to said outer side member.

36. The carrier of claim 34, further comprising a pocket which is provided on said outer side member and which receives at least a portion of said cable lock when said cable lock is not in use.

* * * * *